US007232080B2

(12) United States Patent
Kutay et al.

(10) Patent No.: US 7,232,080 B2
(45) Date of Patent: Jun. 19, 2007

(54) NOZZLE FOR A SPRAY DEVICE

(75) Inventors: Susan Michelle Kutay, Wirral (GB); Gregory Alan Erickson, Rolling Meadows, IL (US)

(73) Assignee: Unilever Home & Personal Care USA Division of Conopco, Inc., Chicago, IL (US)

( * ) Notice: Subject to any disclaimer, the term of this patent is extended or adjusted under 35 U.S.C. 154(b) by 166 days.

(21) Appl. No.: 10/917,191

(22) Filed: Aug. 12, 2004

(65) Prior Publication Data

US 2005/0035218 A1 Feb. 17, 2005

(30) Foreign Application Priority Data

Aug. 13, 2003 (EP) ..... 03255020

(51) Int. Cl.
*B05B 7/10* (2006.01)
*B05B 7/12* (2006.01)

(52) U.S. Cl. ..... 239/398; 239/399; 239/403; 239/405; 239/406; 239/417.5

(58) Field of Classification Search ..... 239/398, 239/399, 403, 405, 406, 402, 416.4, 416.5, 239/417.5, 423
See application file for complete search history.

(56) References Cited

U.S. PATENT DOCUMENTS

| | | | | |
|---|---|---|---|---|
| 3,682,390 A | | 8/1972 | Cheshire et al. | 239/399 |
| 3,901,270 A | | 8/1975 | Smith | 137/351 |
| 3,977,608 A | | 8/1976 | Bullock | 239/410 |
| 4,222,525 A | | 9/1980 | Hildebrandt | 239/343 |
| 4,396,152 A | | 8/1983 | Abplanalp | 239/337 |
| 4,473,185 A | | 9/1984 | Peterson et al. | 239/8 |
| 5,046,667 A | | 9/1991 | Fuhrig | 239/124 |
| 5,192,009 A | | 3/1993 | Hildebrandt et al. | 222/400.5 |
| 5,323,935 A | | 6/1994 | Gosselin et al. | 222/401 |
| 5,730,367 A | | 3/1998 | Pace et al. | 239/408 |
| 5,737,921 A | * | 4/1998 | Jones et al. | 60/740 |
| 5,921,470 A | * | 7/1999 | Kamath | 239/406 |
| 6,123,273 A | * | 9/2000 | Loprinzo et al. | 239/405 |
| 6,260,773 B1 | * | 7/2001 | Kamath | 239/399 |
| 6,272,840 B1 | * | 8/2001 | Crocker et al. | 60/776 |

FOREIGN PATENT DOCUMENTS

| | | |
|---|---|---|
| EP | 1 314 481 | 5/2003 |
| EP | 1 325 782 | 7/2003 |
| FR | 1317768 | 5/1963 |
| GB | 971760 | 10/1964 |
| WO | 00/16026 | 3/2000 |

OTHER PUBLICATIONS

European Search Report in an EP application EP 03 25 5020.
Derwent Abstract of EP 1 314 481—published Sep. 25, 2002.

* cited by examiner

*Primary Examiner*—Davis Hwu
(74) *Attorney, Agent, or Firm*—Karen E. Klumas

(57) ABSTRACT

A nozzle for a spray device comprising a mixing chamber (3) for a first fluid and a second fluid, said mixing chamber (3) having an exit orifice (24), an inlet feed (8) from an inner tubular passage (4) suitable for carrying the first fluid, and an inlet feed (5I) from an annular passage (5) surrounding the inner tubular passage (4) and suitable for carrying the second fluid, characterised in that the nozzle comprises a means for causing spiral flow around the inner tubular passage (4) of a fluid passing through the surrounding annular passage (5).

19 Claims, 3 Drawing Sheets

NOZZLE FOR A SPRAY DEVICE

FIELD OF INVENTION

The present invention is in the field of nozzles for spray devices; particularly nozzles for domestic spray devices and especially nozzles for spray devices used to apply cosmetic compositions onto the human body.

BACKGROUND

Currently marketed domestic spray devices predominately use a liquified propellant to at least in part enable spray generation. A widely used option has been the use of VOCs, such as liquefied hydrocarbons or chlorofluorocarbons, for this purpose. However, it is increasingly recognised that the addition to the atmosphere of VOCs/greenhouse gases may have detrimental environmental consequences.

Sometimes with the aim of reducing the need for VOCs, much research has been performed on high efficiency nozzles for spray devices. Such nozzles may enable spray generation using a reduced level of liquified propellant or even without any liquified propellant at all.

U.S. Pat. No. 5,323,935 (Gosselin et al) describes a nozzle for a spray device in which gas is bubbled into a liquid in a mixing chamber to initiate spray generation. Abplanalp discloses a similar nozzle in U.S. Pat. No. 4,396,152, without disclosing the exact manner of mixing of the gas and liquid. Unfortunately, the nozzles described in both of these publications have limitations in terms of the spray quality attainable and the efficiency of spray generation.

It is an object of the present invention to provide a nozzle for a spray device that enables the production of a spray having good quality (vide infra). It is a further object of the present invention to provide a nozzle for a spray device that enables a good spray rate and/or duration for a given volume of gas used to generate the spray. Preferred embodiments of the invention are of relatively simple design, giving benefits including low cost and ease of manufacturing. Further preferred embodiments are able to operate without the need for large amounts of liquified propellant; indeed certain preferred embodiments are able to operate without the use of any liquified propellant.

The good quality sprays produced by using the present invention are of particular benefit in domestic spray devices, in particular spray devices for cosmetic compositions where a good quality spray equates with good sensory properties for the product.

SUMMARY OF THE INVENTION

In a first aspect of the invention, there is provided a nozzle for a spray device comprising a mixing chamber for a first fluid and a second fluid, said mixing chamber having an exit orifice, an inlet feed from an inner tubular passage suitable for carrying the first fluid, and an inlet feed from an annular passage surrounding the inner tubular passage and suitable for carrying the second fluid, characterised in that the nozzle comprises a means for causing spiral flow around the inner tubular passage of a fluid passing through the surrounding annular passage.

In a second aspect of the invention, there is provided a method of generating a spray comprising passing a contained film of fluid longitudinally through an annular passage surrounding a tubular passage having a second fluid flowing through it in the same longitudinal direction, the two fluids flowing into a chamber where they are mixed, characterised in that the fluid in the annular passage spirals around the tubular passage carrying the second fluid.

In a third aspect of the invention, there is provided a spray device comprising a nozzle as described in the first aspect of the invention.

In a fourth aspect of the invention, there is provided a product comprising a spray device comprising a nozzle as described in the first aspect of the invention and a liquid composition for spraying therefrom.

DETAILED DESCRIPTION

The nozzle according to the invention is capable of mixing gas and liquid to form a good quality spray. In a first embodiment, the annular passage is suitable for carrying liquid to the mixing chamber, the inner tubular passage is suitable for carrying gas towards the mixing the chamber, and the inlet feed from the inner tubular passage is suitable for injecting gas into a liquid film formed in mixing chamber. In other embodiments, the nozzle is suitable for transferring gas via the annular passage and liquid via the inner tubular passage and inlet feed therefrom.

Throughout this specification, states of matter should be understood to refer to those pertaining for a material at standard temperature and pressure (298K; 1 atm.).

The inlet feeds into the mixing chamber may be dimensioned to give a gas to liquid mass ratio (GLMR) therein of greater than 0.06:1, in particular greater than 0.1:1 and especially greater than 0.2:1. The feeds into the mixing chamber may also be dimensioned to give a maximum GLMR that is preferably less than 1:1, more preferably less than 0.8:1 and most preferably less than 0.5:1.

Spray devices incorporating nozzles according to the invention produce sprays having good quality. Spray quality may be defined by the fineness of the droplets achieved and/or by the narrowness of the particle size distribution of said droplets. It is desirable to achieve a Sauter mean particle size (D[3,2]) of from 1:m to 100:m, in particular from 5:m to 60:m, and especially from 5:m to 40:m. The narrowness of particle size distribution may be expressed by the "span", where span is [D(90)−D(10)]/D(50). The present invention preferably operates to give a SPAN of 3 or less, in particular 2.5 or less. The droplet size distribution is measured 15 cm from the exit orifice, typically using a light scattering technique with an instrument such as a Malvern Mastersizer.

A key element of the nozzle of the present invention lies in the fluid dynamics of the fluid in the annular passage feeding the mixing chamber. It is important that the fluid in the annular passage be made to rotate around the inner tubular passage, as well as passing through it in the same longitudinal direction as the fluid in the inner tubular passage. The combination of the rotational motion and longitudinal motion of the fluid produces a spiralling of the fluid around the inner tubular passage. The rotational element of the fluid's flow is maintained until it is mixed with the second fluid, thereby enhancing spray generation in the mixing chamber. The spiral flow of the fluid in the annular passage is brought about before the fluid in this passage reaches the mixing chamber and mixes with the fluid in the inner tubular passage, unlike the situation with conventional swirl chambers.

In general, the means for causing the fluid's spiralling motion provides sufficient angular momentum to the fluid for it to still have rotational motion when it reaches the mixing chamber.

The mixing chamber is typically contiguous with the annular passage, enabling fluid in the annular passage to feed directly into the mixing the chamber. The fluid from the inner tubular passage enters the mixing chamber through one or more inlet feeds, alternatively called injection ports. Each injection port may be from 0.25 to 1.5 mm in diameter and each is preferably from 0.4 to 0.8 mm in diameter. The depth of the mixing chamber, i.e. its minimum cross-sectional dimension, is typically from 0.5 to 6 mm, in particular from 1 to 5 mm and especially from 2 to 4 mm.

The dimensions of the mixing chamber are preferably such as to contain a space that is planar in nature, both of the two orthogonal dimensions of the plane being greater than the depth of the mixing chamber.

In preferred embodiments, gas is passed through the injection ports into liquid in the mixing chamber entering from the annular passage. In such embodiments, it is preferred that the feeds are dimensioned to enable the formation of bubbles of gas in the liquid. It is also preferred that the liquid is passed across the top of the gas injection ports as a film of liquid contained by the walls of the mixing chamber. The dimensions of the mixing chamber are preferably such as to contain a film of liquid that is planar in nature, both of the two orthogonal dimensions of the plane of the film being greater than the depth of the film, in particular being at least twice the depth of the film. Preferably, the gas is introduced into the liquid film from a direction orthogonal to the plane of the film.

The particular dimensions mentioned for the various elements of the nozzle may aid the formation of bubbles of gas in the liquid film in this embodiment.

It is essential that the mixing chamber has an exit orifice for the spray initiated by the mixing of the two fluids. It is preferred that the exit orifice is off-set from the inlet feed or feeds into the mixing chamber from the inner tubular passage. When there is more than one inlet feed into the mixing chamber from the inner tubular passage, it is preferred that the exit orifice is off-set from all of these. The term "off-set" should be understood to mean that the exit orifice is not in line with a given injection port, having regard to the direction of fluid entry into the mixing chamber.

The exit orifice may be from 0.25 to 1.5 mm in diameter and is preferably from 0.4 to 1.2 mm in diameter. The depth of the exit orifice is typically from 10% to 50% greater than its diameter. It may be from 0.3 to 2.5 mm and is preferably from 0.5 to 1.8 mm. The cross-sectional area of the exit orifice relative to the total of the cross-sectional areas of the injection ports may be from 1:1 to 10:1, in particular from 1:1 to 7:1, and especially from 2:1 to 5:1.

The fluid may enter the annular passage through one or more side entry ports. In certain embodiments, the means for causing the fluid's spiral motion comprises one or more non-radial side entry ports. The term "non-radial" should be understood to mean not pointing directly towards the centre of the inner tubular gas passage. Such non-radial side entry ports may be oblique holes in an outer casing of the annular passage. Particularly preferred non-radial side entry ports are tangential side entry ports.

When present, side entry ports typically number from one to four, in particular from one to two, and especially one. They are typically present at the end of the annular passage farthest from the mixing chamber.

In certain embodiments, the means for causing the fluid's spiral motion in the annular passage comprises one or more channels or projections in the annular passage that have both longitudinal and lateral components to their direction. Preferably, their major axis is at an angle of from 15° to 75° relative to the longitudinal axis of the fluid passages. Such projections or channels may exist on the inside of the outer wall of the annular passage or on the outside of the inner tubular passage, the latter surface being the inner wall of the annular passage. Projections in this latter surface are particularly preferred; such projections are typically of width sufficient to span the gap of the annular passage. When present, channels or projections as described in this paragraph typically number from one to ten, in particular from two to eight, and especially from four to six. It is preferred that the channels or projections are evenly distributed around the annular passage. They typically exist in the portion of the annular passage extending from the end farthest from the mixing chamber to a height less than half the vertical length of the annular chamber, particularly to a height greater than one tenth and less than one half the vertical length of the annular chamber, and especially to a height greater than one sixth and less than one third the vertical length of the annular chamber.

Preferred embodiments comprise both one or more channels or projections in the annular passage that have both longitudinal and lateral components to their direction, particularly when these are projections on the outside of the inner tubular gas passage, and one or more side injection ports, in particular non-radial side injection ports, and especially tangential side injection ports. The aforementioned preferred features of the channels or projections in the annular passage also apply to embodiments also having-side injection ports and all the preferred embodiments thereof.

The nozzle may also comprise a means of further increasing droplet break-up; for example, a swirl chamber may be present. The swirl chamber, when present, increases droplet break-up by causing turbulent flow within the fluid mixture entering the same. In a typical embodiment, the swirl chamber is fed by an air-liquid mixture coming out of the exit orifice of the mixing chamber. The air-liquid mixture may feed into the swirl chamber via an annular space leading to the periphery of the swirl chamber. The swirl chamber may be selected from any of the types known in the art, but will typically have from two to six tangential feeder slots leading to a central circular chamber having a discharge orifice located in its centre. The total area of the tangential feeder slots is preferably from 0.33 $mm^2$ to 1.6 $mm^2$. The diameter of the discharge orifice from the swirl chamber may be from 0.1 mm to 1.2 mm, in particular from 0.25 mm to 0.8 mm, and especially from 0.25 mm to 0.6 mm. The depth of the discharge orifice is preferably from two to three times its diameter.

The nozzles of the present invention may comprise an inner and outer element that fit together, e.g. by a snap fit, to form the nozzle. The inner element typically comprises the inner tubular passage, the outer wall of which forms the inner wall of annular passage when inserted into the outer element, and one or more injection ports for transferring fluid from the inner tubular passage into the mixing chamber which is formed between inner element and the outer element when the former is inserted into the latter. The inner element may also comprise a means for causing the fluid within the annular passage to spiral around the inner tubular passage. The outer element typically comprises the outer wall of the annular passage and a portion defining the exit orifice from the mixing chamber formed as described above. The outer element may also comprise a swirl chamber, fed by the air-liquid mixture coming from the exit orifice of the mixing chamber. It may also comprise a means for holding the inner element within it, following insertion.

The nozzle may be manufactured from any appropriate material or combination of materials. Plastic materials such as polyolefins like HDPE or polypropylene may be used; alternatively, metals such as brass or aluminium may be used.

Any appropriate gas may be used with nozzles of the present invention. Nitrogen, carbon dioxide, or air may be used. Air, either compressed or pumped through, is most typically used. A particular advantage of nozzles of the present invention is that they can produce adequate atomisation using pumped air.

The liquid is typically introduced into the nozzle from a storage reservoir. This may be done by using some form of pump or by holding the liquid under pressure and releasing a valve to allow its flow into the nozzle. When pressurised liquid is employed, the pressure may be exerted by any of the means known in the art; for example, a liquified propellant may be added to the liquid.

The nozzles of the present invention may be used with numerous liquids, including liquid compositions used for domestic applications. They are particularly suitable for application of liquid cosmetic compositions, which are typically suitable for direct application to the human body. Examples of such liquid cosmetic compositions include hair sprays, perfume sprays, deodorant body sprays and underarm products, in particular antiperspirant compositions. Nozzles of the present invention are particularly suitable for applying liquid cosmetic compositions to the human body because of the excellent sensory properties that result.

The liquid composition frequently comprises a liquid carrier fluid, for example water and/or a C2 to C4 alcohol like ethanol, propylene glycol, propanol, or iso-propanol. When such liquid compositions are cosmetic compositions for application to the human body, the good spray quality attained leads to an excellent sensory benefit for the user. Suitable liquid compositions typically comprise water and/or C2 to C4 alcohol at a level of from 5% to 95%, in particular from 25% to 95%, and especially from 40% to 95% by weight of the composition. Liquid compositions comprising water and/or ethanol are particularly suitable for use with the device of the present invention.

Liquified propellant may be used as part of a composition sprayed in accordance with the present invention. However, liquified propellant is preferably present at level of 50% or less, more preferably 40% or less and most preferably 0.1% or less by weight of the total composition.

The invention will now be further described by reference to the following Figures, which represent, in part, a preferred embodiment of the invention.

Figure 1:
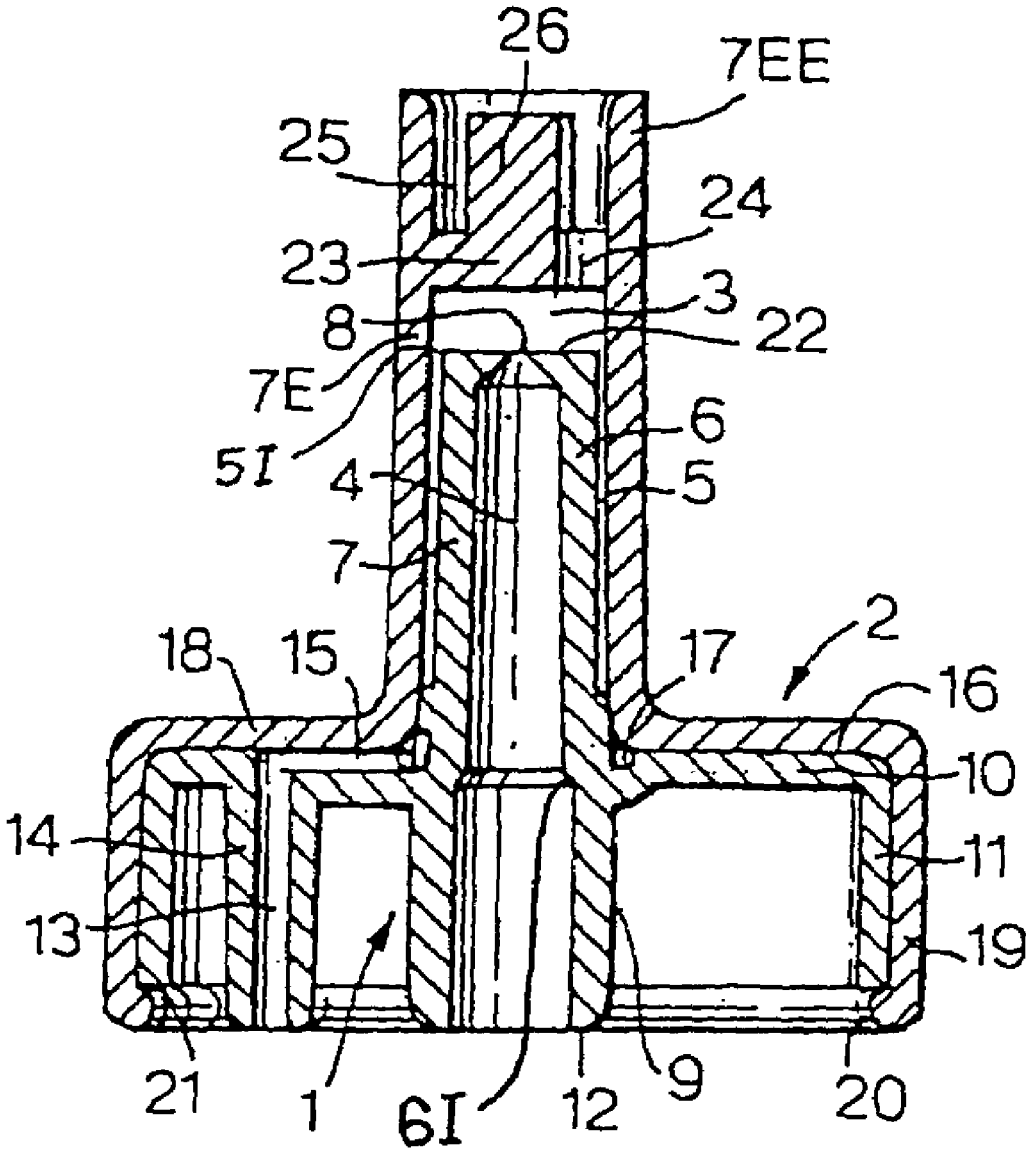
FIG. 1 is a cross-section through the major elements of a preferred embodiment of the invention.
Figure 1A:
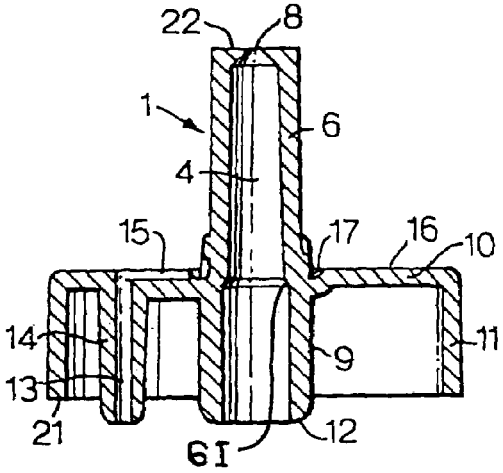
FIGS. 1A and 1B are cross-sections through the inner element (1) and outer element (2) of this embodiment, respectively.
Figure 1B:
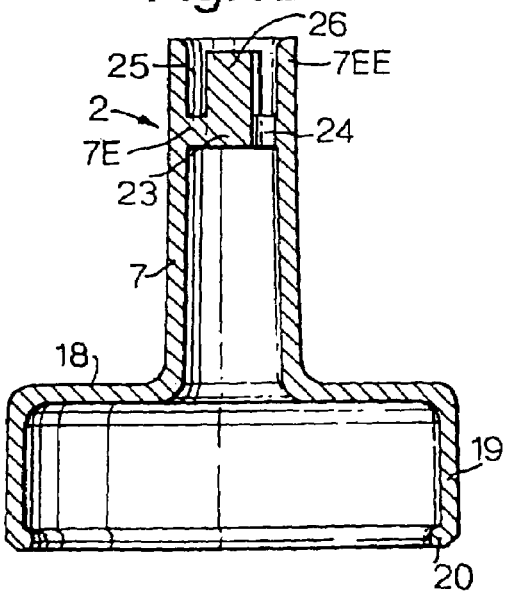
Figure 2:
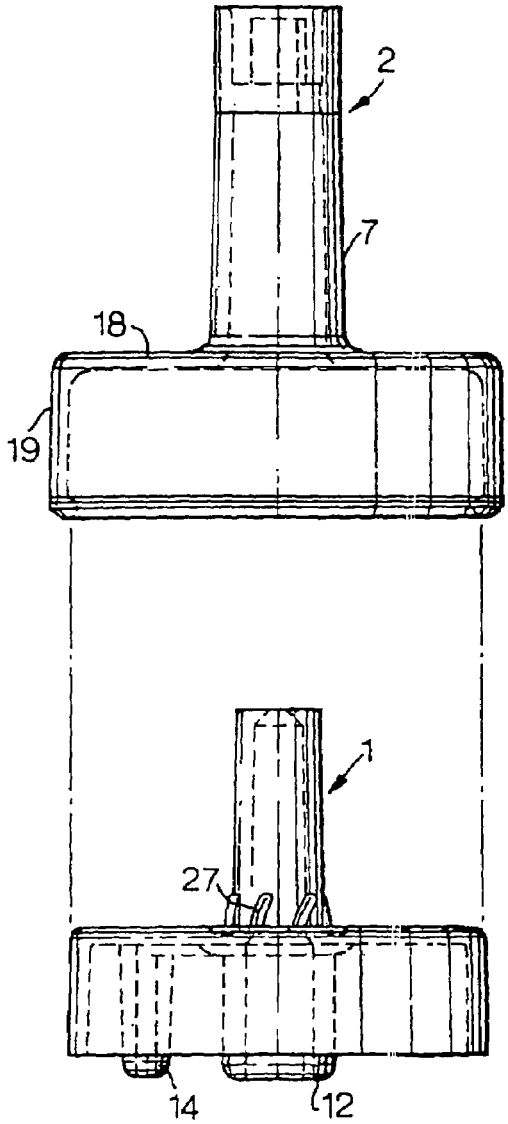
FIG. 2 is an exploded side view of the major elements of this preferred embodiment.

FIG. 1 shows an inner element (1) inserted into an outer element (2); these elements being shown in exploded side view in FIG. 2 and separately in FIGS. 1A and 1B, respectively. A mixing chamber (3) is defined between the inner element (1) and outer element (2), fed by an inner tubular passage (4), and a surrounding annular passage (5). The inner tubular passage (4) is inside a cylindrical wall (6). The annular passage is defined by the outside of the cylindrical wall (6) and the inside of a surrounding cylindrical wall (7). Both the cylindrical wall (6) and the surrounding cylindrical wall (7) decrease steadily in radius of curvature towards the top of the nozzle, at a rate of about 0.17 mm per cm of height. Fluid from the annular passage (5) enters the mixing chamber (3) from its periphery, through an annular inlet feed (5I) and is mixed with fluid from the inner tubular passage (4), which enters the mixing chamber (3) centrally, through an injection port (8). The injection port (8) is of circular cross-section and is chamfered, reducing in dimension towards the mixing chamber (3) at an angle of 45°.

Figure 3:
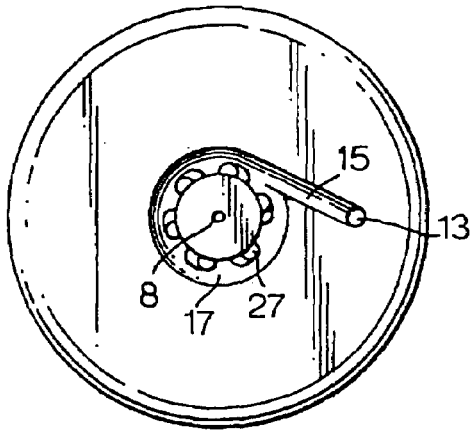
FIGS. 3 and 4 are plan views of the inner element (from above and below, respectively)
Figure 4:
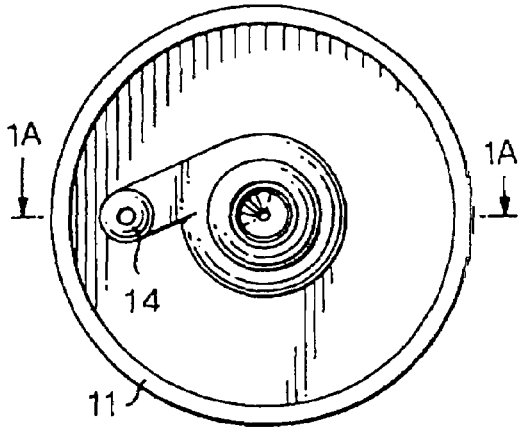

FIG. 1A shows that the cylindrical wall (6) of the inner element (1) has, towards its lower end (9), a horizontal shelf (10), of circular cross-section (see FIGS. 3 and 4), projecting outwards from it. At the periphery of the horizontal shelf (10), there is an annular wall (11) projecting vertically downwards to a depth somewhat less (vide infra) than the lower end (12) of the cylindrical wall (6), which continues downwards in the centre of the space defined by the annular wall (11). Below the point where the horizontal shelf (10) projects outwards, the diameter of the tubular passage (4) increases slightly due to the inside surface (6I) of the cylindrical wall (6) sloping outwards at an angle of about 25° to the longitudinal axis of the passage (4), for a distance equal to the approximately half the depth of the horizontal shelf (10).

Towards the periphery of the horizontal shelf (10), there is a feed tube (13), defined by a cylindrical wall (14), which projects vertically downward to the same depth as the cylindrical wall (6). The feed tube (13) feeds into a tangential slot (15) (better seen in FIG. 3) cut into the top surface (16) of the horizontal shelf (10). The tangential slot (15) feeds into an annular slot (17), also cut into the top surface (16) of the horizontal shelf (10), that surrounds the outside of the cylindrical wall (6). The cylindrical wall (6), the horizontal shelf (10), the annular wall (11), and the cylindrical wall (14) around the feed pipe (13) all form part of the inner element (1) and are all moulded from one piece of material.

Figure 5:
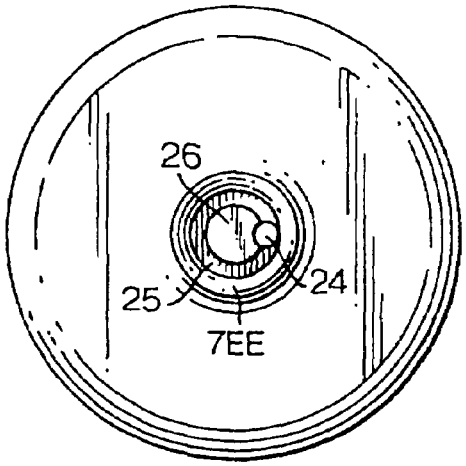
FIGS. 5 and 6 are plan views of the outer element (from above and below, respectively).
Figure 6:
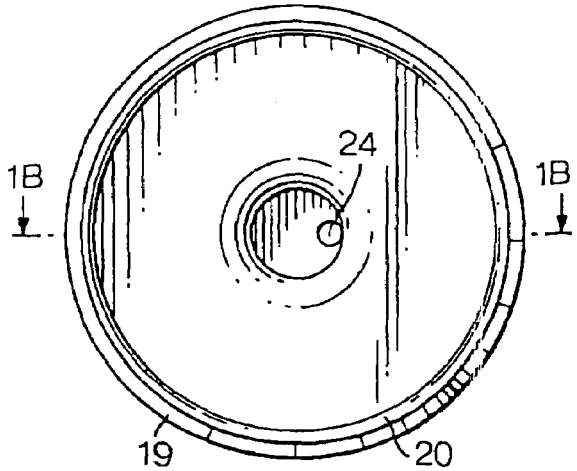

FIGS. 1 and 1B show that the surrounding cylindrical wall (7) of the outer element (2) has a horizontal shelf (18), of circular cross-section (see FIGS. 5 and 6), projecting outwards from it and fitting tightly against the top of the horizontal shelf (10) projecting outwards from the cylindrical wall (6) of the inner element (1). At the periphery of the horizontal shelf (18), there is an annular wall (19) projecting downwards to the same depth as the lower end (12) of the cylindrical wall (6) of the inner element (1) and fitting tightly against the outside of the annular wall (11) of the inner element (1). The outer and inner elements are held tightly together by an annular bead (20) on the lower inside edge of the annular wall (19). The annular bead (20) wraps around the lower end (21) of the annular wall (11) of the inner element (1).

The mixing chamber (3) is defined by a horizontal top wall (22) of the tubular passage (4), an extension (7E) of the cylindrical outer wall (7) of the annular passage (5), and a horizontal platform (23) projecting inwards from the extended cylindrical wall (7E) of the outer element (2). The horizontal platform (23) closes off the mixing chamber (3), apart from an exit orifice (24) cut vertically through the horizontal platform (23). The exit orifice (24) from the mixing chamber (3) is off-set from the injection port (8) feeding fluid from the inner tubular passage (4) into the mixing chamber (3).

Mixed fluids exiting the mixing chamber (3) through the exit orifice (24) enter an annular space (25) defined by a central pin (26) and a surrounding further extension of the cylindrical outer wall (7EE). The further extension to the cylindrical outer wall (7EE) rises to height greater than the top of the central pin (26). This allows for the tight fitting of an appropriately sized swirl chamber insert (not shown) having four tangential feeder slots leading from the periphery to a central circular chamber having a discharge orifice located in its centre.

The surrounding cylindrical wall (7), the horizontal shelf (18), the annular wall (19), the annular bead (20), the horizontal platform (23), the extensions to the annular wall (7E and 7EE), and the central pin (26) all form part of the outer element (2) and are all moulded from one piece of material.

Fluids are fed into the mixing chamber (3) both through the tubular passage (4) and the annular passage (5). Fluid enters the annular passage (5) via the feed pipe (13) and the tangential groove (15). Tangential entry of the fluid into the annular passage (5) and the annular slot (17) creates rotational movement of the fluid around the outside of the cylindrical wall (6). This rotational movement is further augmented by six evenly spaced sloping projections (27) (best shown in FIG. 2) around the base of the annular passage (5) and attached to the outside of the cylindrical wall (6). These projections (27) are of width sufficient to span the gap of the annular passage (5) and are at an angle of 20° to the longitudinal axis of the passages (4 and 5).

The invention claimed is:

1. A nozzle for a spray device comprising a mixing chamber (3) for a first fluid and a second fluid, said mixing chamber (3) having an exit orifice (24), an inlet feed (8) from an inner tubular passage (4) suitable for carrying the first fluid, and an inlet feed (5I) from an annular passage (5) surrounding the inner tubular passage (4) and suitable for carrying the second fluid, characterised in that the nozzle comprises a means for causing spiral flow around the inner tubular passage (4) of a fluid passing through the surrounding annular passage (5), wherein the annular passage (5) is suitable for carrying liquid to the mixing chamber (3), the inner tubular passage (4) is suitable for carrying gas towards the mixing chamber (3), and the inlet feed (8) from the inner tubular passage (4) is suitable for injecting gas into a liquid film formed in mixing chamber (3).

2. A nozzle according to claim 1, wherein the inlet feeds (5I and 8) are dimensioned to give a gas to liquid mass ratio in the mixing chamber (3) of greater than 0.06:1 and less than 1:1.

3. A nozzle according to claim 1, wherein the inlet feeds (5I and 8) are dimensioned to enable the formation of bubbles in the liquid in the mixing chamber (3).

4. A nozzle according to claim 1, wherein the means for causing spiral flow provides sufficient angular momentum to the fluid in the annular passage (5) for it to still have rotational motion when it reaches the mixing chamber (3).

5. A nozzle according to claim 1, wherein the mixing chamber (3) is contiguous with the annular passage (5), allowing fluid in the annular passage (5) to feed directly into the mixing chamber (3).

6. A nozzle according to claim 1, wherein the dimensions of the mixing chamber (3) are such as to be capable of containing a film that is planar in nature and has two orthogonal dimensions that are greater than its depth.

7. A nozzle according to claim 1, wherein exit orifice (24) is off-set from the inlet feed (8) into the mixing chamber (3) from the inner tubular passage (4).

8. A nozzle according to claim 1, wherein the cross-sectional area of the exit orifice (24) relative to the total of the cross-sectional areas of inlet feeds (8) into the mixing chamber (3) from the inner tubular passage (4) is from 2:1 to 5:1.

9. A nozzle according to claim 1, wherein the means for causing spiral flow comprises one or more non-radial side entry ports (15) into the annular passage (5).

10. A nozzle according to claim 1, wherein the means for causing spiral flow comprises one or more channels or projections (27) in the annular passage (5) that have both longitudinal and lateral components to their direction.

11. A nozzle according to claim 10, wherein the means for causing spiral flow comprises one or more projections (27) on the outside of the inner tubular passage (6) having both longitudinal and lateral components to their direction.

12. A nozzle according to claim 1, comprising a means of further increasing droplet break-up.

13. A nozzle according to claim 12, wherein the means of further increasing droplet break-up is a swirl chamber.

14. A nozzle according to claim 1, comprising an inner element (1) and an outer element (2) that fit together to form the nozzle.

15. A domestic spray device comprising a nozzle according to claim 1.

16. A product comprising a spray device according to claim 15 and a liquid composition for spraying therefrom.

17. A product comprising a spray device according to claim 16 and a liquid cosmetic composition for spraying therefrom.

18. A product according to claim 17 wherein the liquid cosmetic composition is selected from the group consisting of hairsprays, perfume sprays, deodorant body sprays and underarm products.

19. A nozzle for a spray device comprising a mixing chamber (3) for a first fluid and a second fluid, said mixing chamber (3) having an exit orifice (24), an inlet feed (8) from an inner tubular passage (4) suitable for carrying the first fluid, and an inlet feed (5I) from an annular passage (5) surrounding the inner tubular passage (4) and suitable for carrying the second fluid, characterized in that the nozzle comprises a means for causing spiral flow around the inner tubular passage (4) of a fluid passing through the surrounding annular passage (5), and wherein the nozzle further comprises a swirl chamber fed by an air-liquid mixture coming out of the exit orifice (24) of the mixing chamber (3) and has from two to six tangential feeder slots leading to a central circular chamber having a discharge orifice located in its centre.

* * * * *